United States Patent [19]

Bowen et al.

[11] Patent Number: 4,900,635

[45] Date of Patent: Feb. 13, 1990

[54] MULTI-ALLOY TURBINE ROTOR DISK

[75] Inventors: Kim E. Bowen, Whitehall; Steven M. Foster, Wixom, both of Mich.; Said Izadi, San Diego, Calif.

[73] Assignee: Williams International Corporation, Walled Lake, Mich.

[21] Appl. No.: 307,923

[22] Filed: Feb. 9, 1989

Related U.S. Application Data

[62] Division of Ser. No. 78,396, Jul. 27, 1987, Pat. No. 4,851,190.

[51] Int. Cl.[4] ..... B22F 3/00

[52] U.S. Cl. ..... 428/547; 428/610; 415/212.1

[58] Field of Search ..... 428/547, 610; 415/212 R

[56] References Cited

U.S. PATENT DOCUMENTS

| | | | |
|---|---|---|---|
| 4,643,648 | 2/1987 | Hüller | 428/427 |
| 4,663,241 | 5/1987 | Doherty | 428/427 |

*Primary Examiner*—Stephen J. Lechert, Jr.
*Attorney, Agent, or Firm*—Lyman R. Lyon

[57] ABSTRACT

The disclosure relates to a turbine disk and a method of making the turbine disk comprising the steps of rotating a mold, adding a first powdered metal to the rotating mold at a first rate, reducing the rate of addition of the first metal to a second rate, and adding a second powdered metal to the mold at a third rate substantially equal to the difference between the first and second rates.

3 Claims, 1 Drawing Sheet

FIG. 1.
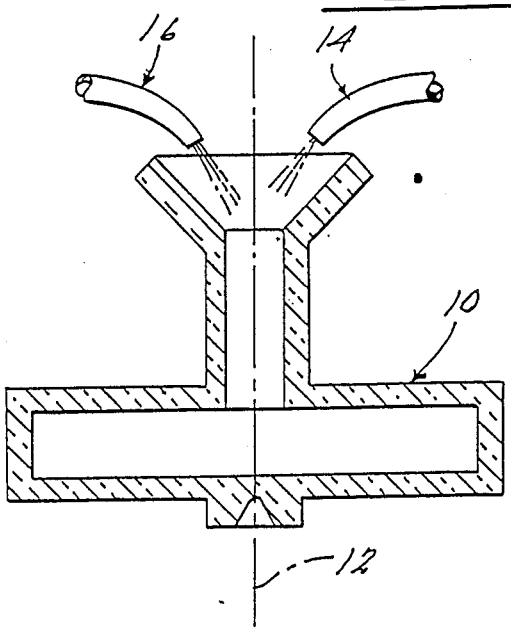
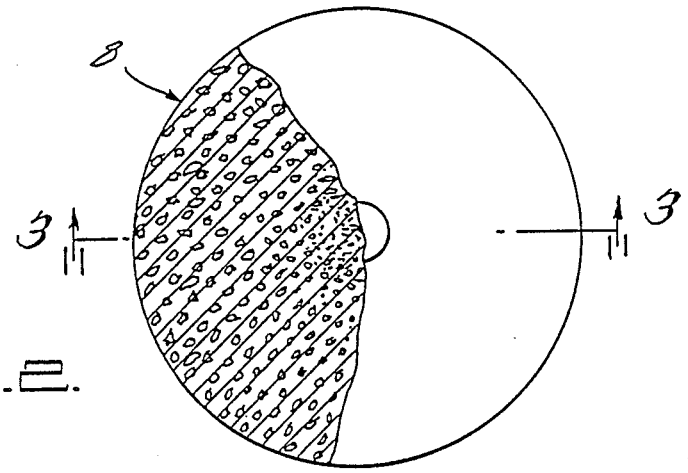
FIG. 2.
FIG. 3.
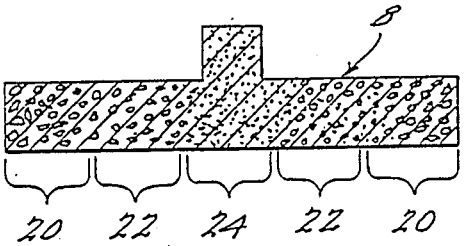
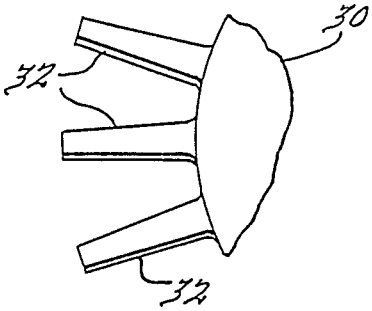
FIG. 4.

MULTI-ALLOY TURBINE ROTOR DISK

This is a divisional of co-pending application Ser. No. 078,396 filed on July 27, 1987, U.S. Pat. No. 4,851,190.

BACKGROUND OF THE INVENTION

Performance of a gas turbine engine is directly related to the temperature of the combustion gases at the inlet to the turbine. However, while it is desirable to maximize rotor inlet temperature, inlet temperatures above 2000° F. require the use of advanced super alloy materials which are generally not compatible with the mechanical properties of the rotor disk.

SUMMARY OF THE INVENTION

The multiple property disk of the instant invention solves the aforesaid problem. A gradient in composition or grain size is obtained in a radial direction whereby a turbine disk exhibits moderate creep strength and superior tensile strength at the shaft or bore combined with high creep strength and moderate tensile strength at the rim. The disk is fabricated by rotating a glass or metal mold about its centerline at substantial RPM with or without supplemental vibratory motion. Initial powder compaction in the mold is achieved by centrifugal force. Final densification is obtained by hot isostatic pressing or consolidation at atmospheric pressure (CAP).

Initial centrifugal compaction facilitates the formation of a large gradient zone and eliminates distortion of the gradient zone during subsequent compaction. The radial centrifugal compaction process holds the powder particles in place with enough force to prevent substantial deformation of the gradient zone.

Two methods of obtaining the multiple property disks are employed. Large grain materials, i.e. materials which tend to have superior creep strength with moderate tensile strength, are first poured into a rotating mold. This material is centrifuged to the outer diameter of the mold. After achieving a predetermined radial thickness of coarse powder, fine powder of the same alloy composition is admixed at an increasing rate, while the coarse powder fill rate is simultaneously decreased. This dynamic change in powder size is maintained through the intermediate region of the disk. At the central region only fine-powder, i.e. high tensile strength/moderate creep strength, is used to fill the mold.

A second method involves addition of a powder alloy with good creep strength to a rotating mold and centrifuging it to the outer diameter. After achieving a predetermined radial thickness with this alloy, a different alloy with superior tensile strength and moderate creep strength is admixed at an ever increasing rate, while the first alloy fill rate is simultaneously decreased. The dynamic change in powder composition is maintained to the intermediate region of the disk. At the center of the disk only the second alloy is added to the mold. In this method the alloy composition and particle size distribution will be selected on the basis of mechanical properties, grain growth kinetics, and compaction parameters.

The combination of variables such as grain size and/or alloy composition results in a multiple property disk. Depending on the extent of the property variations required and the compatibility of the different alloys, intermediate or boundary layer alloys may be desired as interface layers between the bore and rim alloys. This may be used to bolster strength and/or prevent deleterious phase formation. Additionally, blades of any desired physical characteristic can be formed integrally on the periphery of the disk.

The rotating mold method of compaction can be used for powdered alloys of almost any composition. Some examples are superalloys, titanium alloys, dispersion strengthened alloys, cemented carbide cutting tools exhibiting increased wear resistance on the outer edges and increased ductility in the center region, ceramics, and low melting alloys.

Almost any powdered material which can be normally processed through conventional powdered metal processing can be used in the rotating mold technique to develop components that have gradient material structures with attendant multiple/properties.

BRIEF DESCRIPTION OF THE DRAWING

FIG. 1 is a cross-sectional elevation of a rotatable mold in accordance with the present invention;

FIG. 2 is a view, partially broken away, of a turbine rotor disc formed in accordance with the invention;

FIG. 3 is a view taken along the line 3—3 of FIG. 2; and

FIG. 4 is a view similar to FIG. 2 of a disc configuration having integral blades.

DETAILED DESCRIPTION OF THE PREFERRED EMBODIMENT OF THE INVENTION

As seen in FIG. 1, a powder alloy with good creep strength is added to a rotating mold 10 from a container 14. After achieving a predetermined radial thickness with this alloy, a different alloy with superior tensile strength and moderate creep strength is admixed from a container 16 at an ever increasing rate, while the first alloy fill rate is simultaneously decreased. In this method the alloy composition and particle size distribution will be selected on the basis of mechanical properties, grain growth kinetics, and compaction parameters.

Hot isostatic pressing is accomplished at standard condition for a given alloy; i.e., Ti 64 @ 15 Ksi, 1650° F., 3 hrs; Astroloy @ 30 Ksi, 2150° F., 3 hrs. Consolidation is achieved at standard Atmospheric Pressure conditions for a given alloy; i.e., AF2-IDA-6 @ 2340° F. for 40 hrs.

As seen in FIGS. 2 and 3, the combination of variables such as grain size and/or alloy composition results in a multiple property disk having a radially outer zone 20, an intermediate zone 22, and a central zone 24.

From the foregoing it should be apparent that both superalloy and titanium gradient structures may be formed by centrifugal force in a rotating mold, enhanced by vibratory motion if desired, followed by CAP and/or HIP consolidation. The rotating mold "Locks" the powdered particles into position and the CAP and/or HIP operation affects further compaction without gross material movement. Without the degree of compaction offered by centrifugal force, the powder would move substantially during the CAP and/or HIP consolidation step, thus destroying the gradient strata effect.

The disclosed method constitutes a relatively low cost approach to multiple property rotor technology. It does not require diffusion bonding between the disk and ring. The concept offers a diffuse interface with better mechanical properties than the sharp interfaces associated with diffusion bonding which have been found to retain approximately 90% of the parent metal mechanical properties. In summary, the method of the instant invention exhibits distinct advantages over the prior art, namely:

(1) The graded multi-alloy turbine disk does not require diffusion bonding.

(2) The graded concept is a one-step process rather than a multi-step process, as is diffusion bonding.

(3) Disk integrity is improved with the incorporation of a diffuse interface.

(4) Diffusion parameters for dissimilar alloys will not have to be developed.

While the preferred embodiment of the invention has been disclosed, it should be appreciated that the invention is susceptible of modification without departing from the scope of the following claims.

We claim:

1. A turbine disk comprising a first grain structure exhibiting relatively high creep strength and moderate tensile strength on the radially outer perimeter thereof, a second grain structure exhibiting relatively high tensile strength and moderate creep strength at the center thereof, and a transition zone between said first grain structure on the radially outer perimeter of said disk and the second grain structure at the center of said disk, said transition zone comprising both said first and second grain structures and exhibiting a gradual change from said first grain structure radially inwardly to said second grain structure without significant stratification.

2. The turbine disk of claim 1 wherein said first grain structure comprises relatively large grains and said second grain structure comprises relatively small grains.

3. The turbine disk of claim 1 wherein said first and second grain structures comprise different metals.

* * * * *